United States Patent [19]

Wiktor et al.

[11] Patent Number: 5,066,840

[45] Date of Patent: Nov. 19, 1991

[54] MANUAL OPERATOR FOR AN ELECTRICAL SWITCH

[75] Inventors: Dominik M. Wiktor, Cranford; Siegfried Schlindwein, Succasunna, both of N.J.

[73] Assignee: Automatic Switch Company, Florham Park, N.J.

[21] Appl. No.: 597,197

[22] Filed: Oct. 9, 1990

[51] Int. Cl.[5] ..... H01H 3/10

[52] U.S. Cl. ..... 200/330; 74/504; 200/336; 200/331

[58] Field of Search ..... 200/330, 331, 336; 74/504; 16/110 R

[56] References Cited

U.S. PATENT DOCUMENTS

| | | | |
|---|---|---|---|
| 2,658,979 | 11/1953 | Jungholm | 200/331 |
| 2,853,897 | 9/1958 | Loewy | 200/331 X |
| 3,438,662 | 4/1969 | Cowal et al. | 200/331 X |

FOREIGN PATENT DOCUMENTS

| | | | |
|---|---|---|---|
| 2149972 | 6/1985 | United Kingdom | 200/331 |

*Primary Examiner*—Ernest G. Cusick

*Attorney, Agent, or Firm*—Alan H. Levine

[57] ABSTRACT

A manual operator for opening and closing an electrical switch, including a switch-driving element, a relatively rotatable handle element, and a resilient transmission, e.g., a leaf spring or springs, extending between the two elements. An abutment is fixed to one of the elements and a follower is fixed to the other, the abutment engaging the follower only after the resilient transmission has been tensioned by rotation of the handle element. When the driving element engages a portion of the switch mechanism, initial rotation of the handle causes the resilient transmission to be tensioned and the abutment to engage the follower. Further rotation of the handle is transmitted through the abutment and follower to the driving element to initiate the movement of the switch mechanism, following which the tensioned resilient transmission instantly shifts the switch mechanism through the remainder of its movement to snap the switch open or closed. A latch optionally rigidly interconnects the handle and driving elements to bypass the resilient transmission and transmit any rotation of the handle directly to the driving element.

14 Claims, 4 Drawing Sheets

MANUAL OPERATOR FOR AN ELECTRICAL SWITCH

This invention relates to relatively large electrical switches, and more particularly to a manual operator for opening and closing such a switch.

Power disconnect switches, circuit breakers and interrupters, and transfer switches which carry large electrical currents typically incorporate "stored energy" mechanisms, usually involving tension or compression springs, for insuring very rapid, i.e., instantaneous, separation and engagement of the switch contacts upon opening and closing of the switch, respectively.

The stored energy mechanisms now in use are built into the switches, usually as part of the switch operating arrangement. Whether the switch operator is electrically or manually controlled, it is essential that the switch contacts make (close) and break (open) extremely rapidly when the switch is carrying electric current. Slow opening or closing of load carrying power contacts is extremely dangerous since a relatively long, uncontrolled arc will usually be drawn between the contacts which can cause serious injury to the person operating the switch, as well as considerable damage to the equipment. Rapid operation of the switches minimizes arcing and enables the arcs which are drawn to be quickly extinguished.

It is sometimes necessary to open a load-carrying switch manually, or to manually close a switch on to a live source of power. In either case, it would be desirable to have a manual operator which insures rapid shifting of the switch mechanism to instantaneously snap the switch open or closed, so as to avoid a hazardous arcing situation.

While rapid operation of such switches is critical when the switch contacts are carrying a load, it is also important to be able to operate the switch slowly, when the latter is unloaded, for purposes of testing and adjusting the switch components.

It is, therefore, an object of the present invention to provide a manual operator for an electrical switch which carries a built-in stored energy arrangement for producing a very high speed shifting of the switch between open and closed conditions.

It is another object of the invention to provide such an operator which causes instantaneous operation of the switch independent of the rate at which the user manipulates the operator.

It is a further object of the invention to provide such an operator having a mode in which the stored energy, or spring, arrangement of the operator is optionally bypassed, so that the operator can be used to slowly open an unloaded switch, when desired.

It is an additional object of the invention to provide such an operator wherein the "stored energy" feature involves one or more flat leaf springs, the leaf springs being twisted to store energy during the initial rotation of the operator handle, following which the leaf springs rapidly untwist to quickly snap open or closed the switch being operated.

Additional objects and features of the invention will be apparent from the following description in which reference is made to the accompanying drawings.

Figure 2:
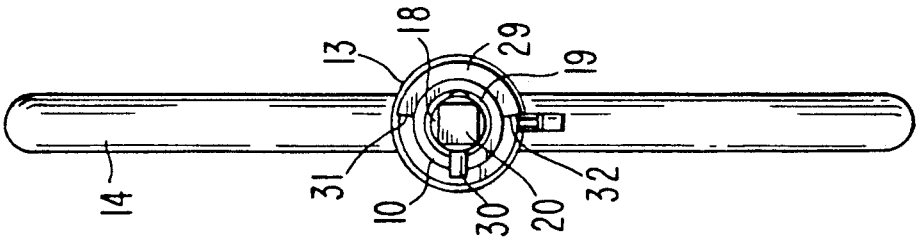
FIG. 2 is an end view of the operator, from the right side of FIG. 1.
Figure 1:
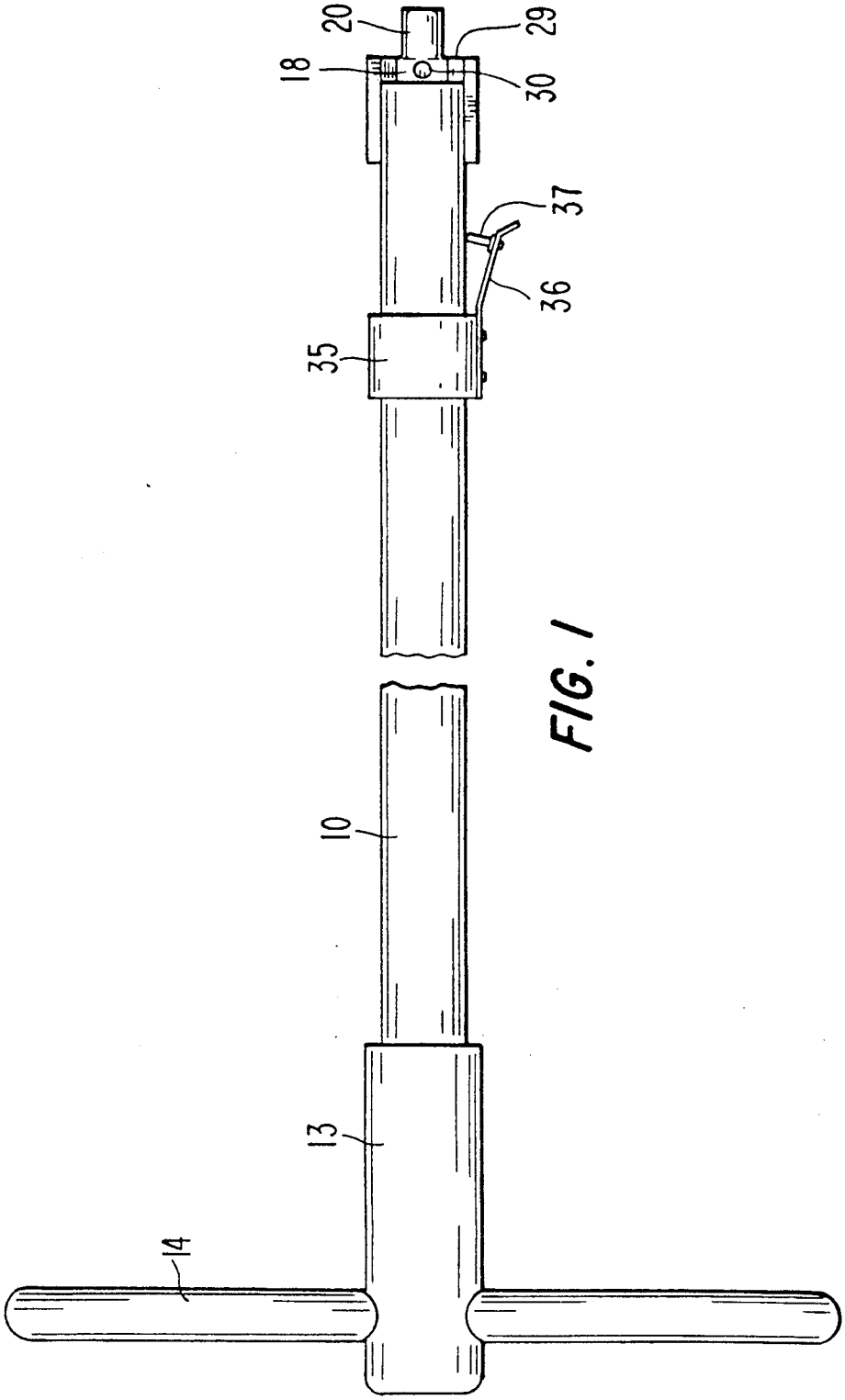
FIG. 1 is a side view of a manual operator for an electrical switch according to the invention.
Figures 3, 3A:
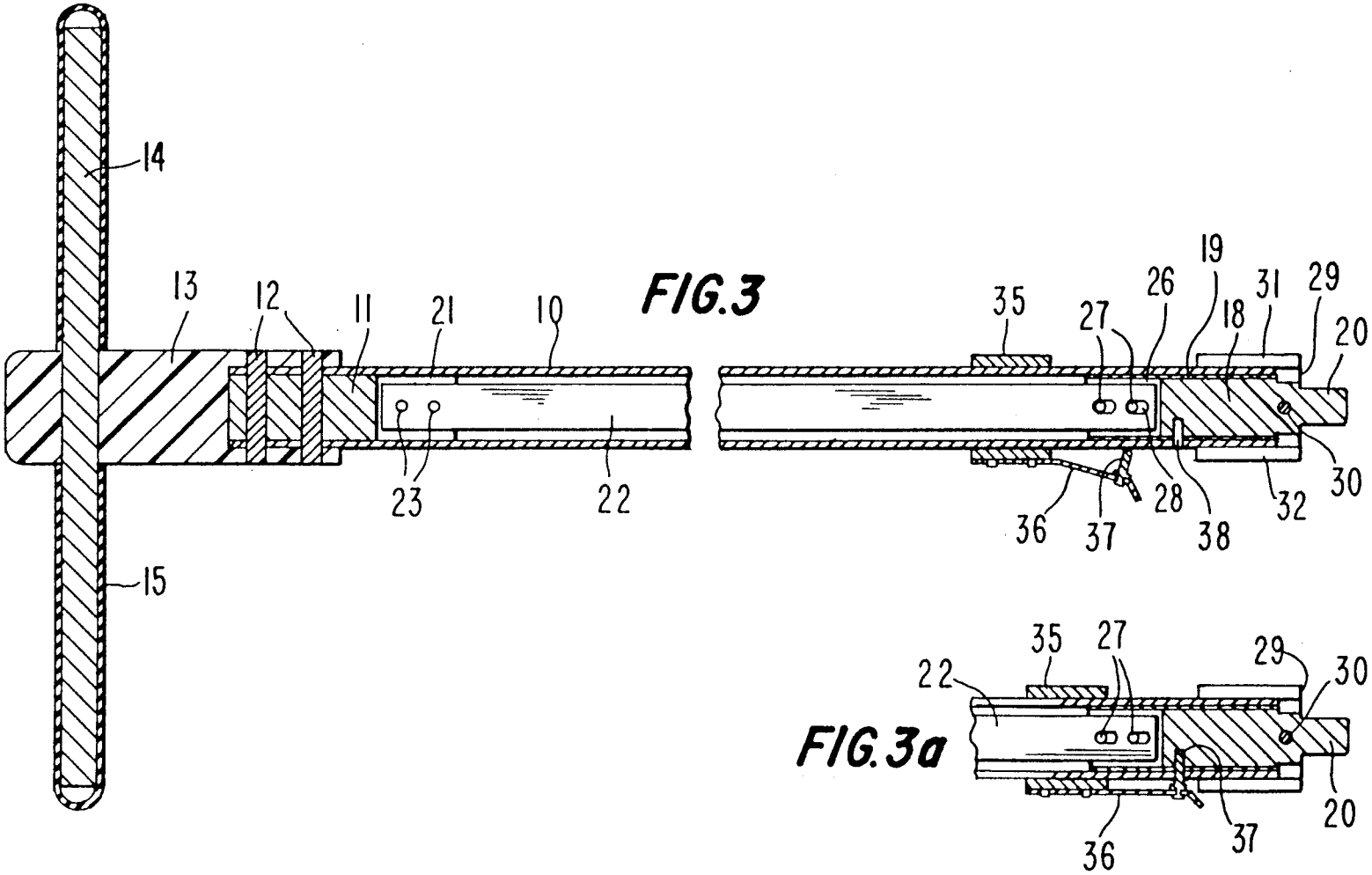
FIG. 3 is a longitudinal cross-sectional view of the operator, the leaf springs being untensioned and the latch being disengaged.
Figure 4:
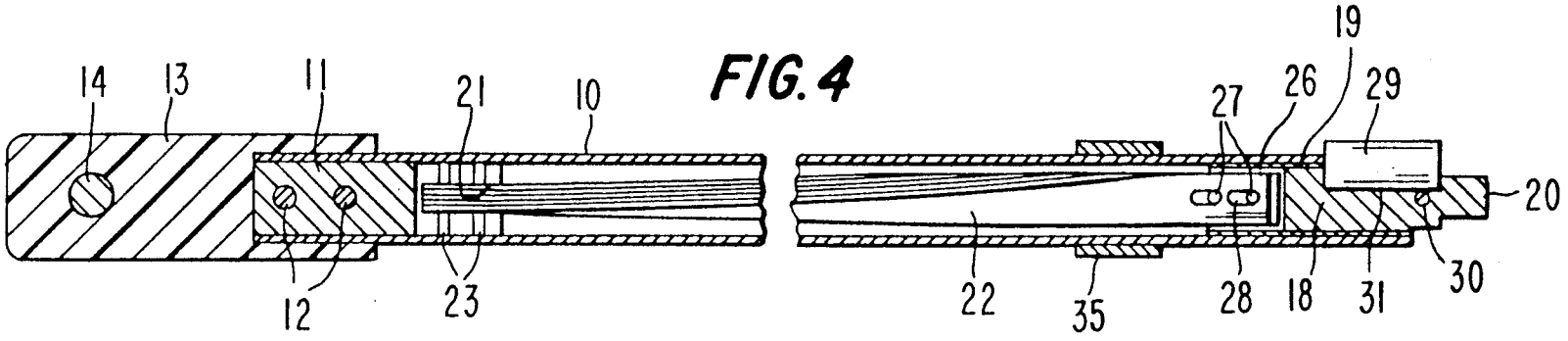
Figure 5:
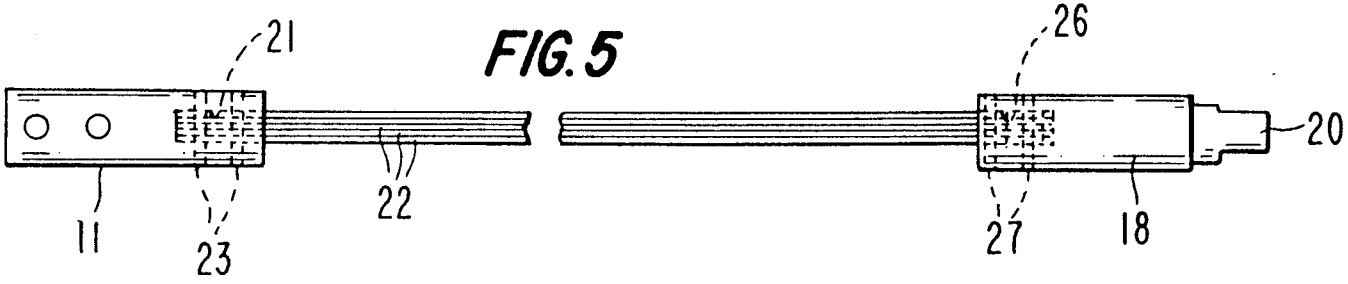
Figure 8:
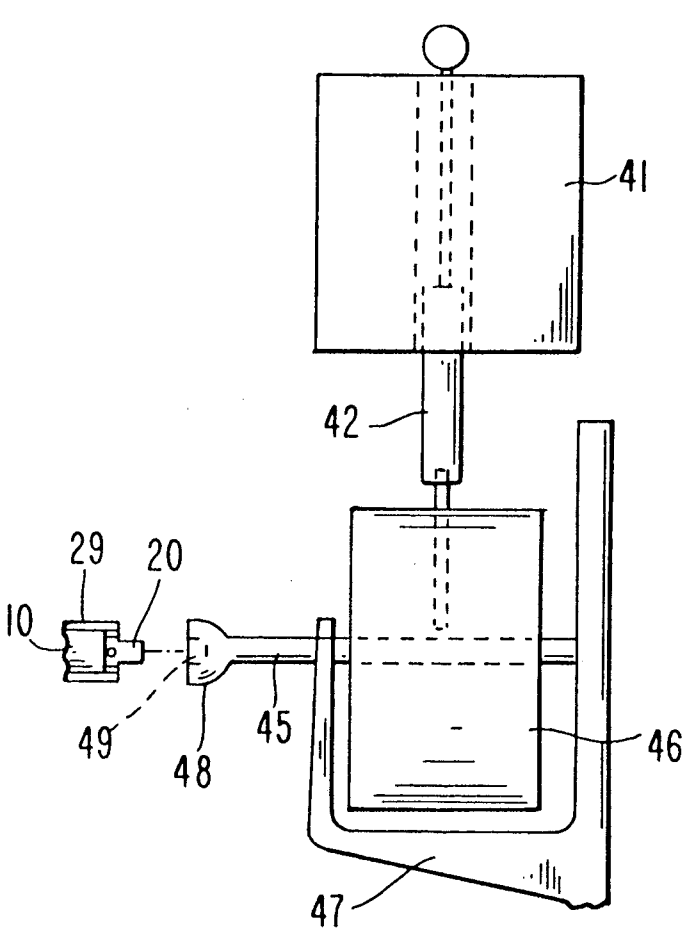
Figure 7:
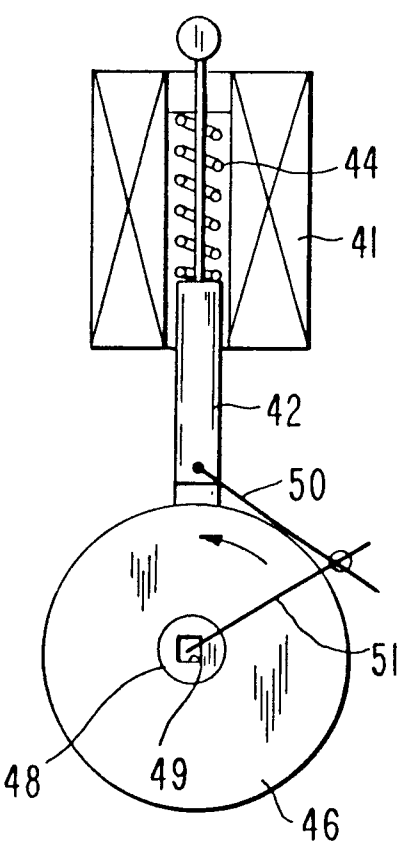
Figure 6:
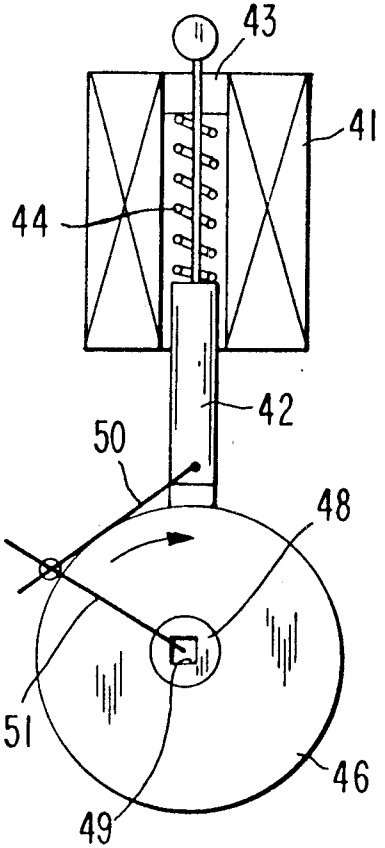

FIG. 3*a* is a view of a portion of FIG. 3, showing the latch engaged;

FIG. 4 is a longitudinal cross-sectional view of the operator, the leaf springs being tensioned;

FIG. 5 is a view of the leaf springs and the anchors to which the ends of the springs are connected;

FIGS. 6 and 7 are schematic front views of a conventional type of electrically-controlled power switch operator, the switch contacts (not shown) being closed in FIG. 6 and open in FIG. 7; and FIG. 8 is a schematic side view of the switch operator of FIGS. 6 and 7.

The manual operator for opening and closing an electrical switch, chosen to illustrate the present invention, includes a hollow, rigid tube 10 (FIGS. 1–4), formed of metal or other suitable material. Accommodated within one end of the tube is a spring anchor 11 fixed to tube 10 by a pair of pins 12 passing through aligned holes in the tube and anchor. Pins 12 extend beyond the outer surface of tube 10 and serve to fix to the tube and anchor 11 a hub 13 of insulator material. One end of hub 13 is formed with a bore for accommodating the end of tube 10, pins 12 passing through aligned holes in the hub and tube. Extending crosswise through an opening in hub 13 is a rigid handle bar 14 covered by a suitable grip material 15. Handle bar 14 and hub 13 constitute a handle element by means of which tube 10 and spring anchor 11 can be rotated.

Accommodated within the other end of tube 10 is a generally cylindrical switch-driving element 18. Element 18 is rotatable with respect to tube 10 by means of a sleeve bearing 19 within the tube and surrounding element 18. An integral extension 20 of driving element 18 projects beyond the end of tube 10 and has a non-circular cross-sectional shape, in this case square (see FIG. 2). The extension is adapted to cooperate with the switch mechanism when the operator of this invention is used to open or close a switch.

The inner end of anchor 13 is formed with a slot 21 (FIGS. 3–5) for accommodating the end of a resilient leaf spring arrangement, which may be one or more individual leaf springs. In the present example, five side-by-side leaf springs 22 are employed. The leaf springs 22 extend longitudinally within tube 10, and one end of the leaf spring arrangement 22 is fixed to anchor 11 by two pins 23 passing through aligned holes in the springs and anchor.

The other end of the leaf spring arrangement 22 is accommodated within a slot 26 formed in the inner end of driving element 18. Two pins 27, passing through aligned holes in the leaf springs and element 18, secure that end of the leaf spring arrangement to the driving element. The holes 28 in the leaf springs, through which pins 27 pass, are elongated to provide for some relative longitudinal movement between springs 22 and driving element 18. This is useful, since springs 22 become somewhat shortened when they are twisted (compare FIGS. 3 and 4).

At its end near driving element 18, tube 10 is furnished with an abutment in the form of a semicylindrical collar 29 fixed, as by welding, to the outer surface of the tube. The collar projects a little beyond the end of tube 10. Projecting radially from driving element 18, at a point between the end of tube 10 and extension 20, is a follower in the form of a pin 30. Pin 30 is fixed to and rotates with element 18. When springs 22 are untensioned, i.e., untwisted, pin 30 is located about equidistantly from the edges 31 and 32 of collar 29, and in the path of movement of those edges (the collar 29 moving with tube 10 when handle bar 14 is rotated).

Slidably arranged on, and surrounding, tube 10 is a sleeve 35 to which is secured a springy finger 36 carrying a latch pin 37. Tube 10 is furnished with a hole and driving element 18 with a socket 38, the hole being aligned with the socket when springs 22 are untensioned (FIGS. 3 and 3*a*). Sleeve 35 may be slid longitudinally along tube 10 so as to enable latch pin 37 to be inserted into socket 38 (FIG. 3). In this condition, driving element 18 is rendered non-rotatable with respect to tube 10 and hence with respect to handle bar 14.

The manual switch operator described above may be used with a wide variety of electric power switches, such as a switch having the conventional electrical operator illustrated in FIGS. 6–8. The electrical operator includes an electric solenoid winding 41 within which is an axially movable core or armature 42 and a stationary armature or plugnut 43. A compression spring 44, between the two armatures, constantly urges the movable armature 42 downwardly in FIGS. 6–8 out of the winding 41. When winding 41 is energized, armature 42 moves upwardly toward stationary armature 43, and upon deenergization of the winding, spring 44 returns armature 42 downwardly to its position shown in the drawings.

The switch contacts (not shown) are opened and closed in response to rotation of a shaft 45 (FIG. 8), carrying a cylindrical weight 46, supported by a fixed bracket 47. The free end of shaft 45 is formed with an enlargement 48 having a square socket 49 adapted to accommodate, in non-rotatable fashion, the square extension 20 of driving element 18. A pair of links 50 and 51 pivotally interconnect movable armature 42 and shaft 45 in the manner of a toggle or over-center mechanism.

Assume that in the position of FIG. 6, the switch is closed, and it is desired to open it. Winding 41 is energized momentarily, causing armature 42 to rise, thereby bringing links 50 and 51 toward a condition of alignment and rotating weight 46 in the direction of the arrow in FIG. 6. Upon deenergization of the winding, the inertia of moving weight 46 snaps links 50 and 51 through their position of alignment and together with spring 44 moves the links, weight, and shaft 45 to the position shown in FIG. 7, wherein the switch contacts are open. If winding 41 is momentarily energized again, the same movement takes place, except in reverse (see arrow in FIG. 7) whereby the parts move from their FIG. 7 position to their FIG. 6 position, causing the switch to close.

Should it be necessary to open the switch manually, while it is carrying load current, the operator of this invention comes into play. Extension 20 of switch-driving element 18 is inserted into socket 49 of shaft 45 (FIG. 8). Handle bar 14 is then rotated in a clockwise direction (as viewed in FIG. 6). During about the first 90° of this rotation, driving element 18 does not turn, because it is held stationary by the switch mechanism, especially spring 44 and its associated parts. Instead, only hub 13 and tube 10 rotate as well as the end of leaf springs 22 held by anchor 11. The result is that leaf springs 22 are twisted about their longitudinal axes, as shown in FIG. 4, whereby energy is stored in the springs.

At the end of about the first 90° of rotation, edge 31 of collar 29 engages pin 30, projecting from driving element 18 (see FIG. 4) As manual rotation continues, the engagement between collar 29 and pin 30 causes driving element 18, and hence shaft 45 to start rotating. This is equivalent to the rise of armature 42 in response to energization of winding 41. When handle 14 is rotated far enough so that links 50 and 51 move into or just past alignment, the resistance of the switch mechanism to further rotation disappears. As a result, the twisted leaf springs suddenly straighten out (FIG. 3) giving up their stored energy to rapidly complete the movement of the switch mechanism from its FIG. 6 to its FIG. 7 condition, whereupon the switch contacts open at very high speed.

To close the switch, handle bar 14 is rotated counterclockwise (as viewed in FIG. 7). Leaf springs 22 become twisted in the opposite direction until edge 32 of collar 29 engages pin 30. The operation is then as described above, the latter part of the movement from the FIG. 7 to the FIG. 6 position being accomplished very rapidly as springs 22 give up their stored energy to rotate the switch mechanism and close the the switch contacts.

If it is desired to use the manual operator of this invention to slowly open and close the switch, when the latter is not carrying load, for the purpose of testing and adjusting the switch parts, springs 22 can be bypassed. Sleeve 35 is slid along tube 10 until latch pin 37 can be inserted into the hole in tube 10 and socket 38 in driving element 18 to lock the tube and driving element together. In this way, rotation of handle bar 14 is transmitted in a rigid manner to driving element 18 through hub 13, anchor 11, tube 10, and latch pin 37, without the intervention of leaf springs 22.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A manual operator for opening and closing an electrical switch having a mechanism including a portion adapted to be rotated to operate the switch, comprising:

a switch-driving element adapted to non-rotatably engage the rotatable portion of the switch mechanism, a handle element rotatable with respect to the switch-driving element, resilient means operatively interposed between the switch-driving element and the handle element, the resilient means being tensioned when the handle element is rotated while the driving element is maintained stationary, an abutment fixed to and moveable with one of the elements, and a follower fixed to and moveable with the other of the elements, the follower being located in the path of movement of the abutment, and the follower and abutment being so relatively located that the abutment engages the follower only after the resilient means has been tensioned by rotation of the handle element, so that when the switch-driving element engages the rotatable portion of the switch mechanism, initial rotation of the handle element causes the resilient means to be tensioned and the abutment to engage the follower, further rotation of the handle element being transmitted through the abutment and follower to the switch-driving element to initiate movement of the switch mechanism, following which the resilient means instantly shifts the switch mechanism through the remainder of its movement to snap the switch open or closed.

2. A manual operator as defined in claim 1 wherein the resilient means comprises at least one leaf spring, the at least one leaf spring being twisted about is longitudinal axis, to tension it, in response to relative rotation between the handle element and the switch-driving element.

3. A manual operator as defined in claim 2 including means for non-rotatably connecting one end of the at least one leaf spring to the handle element and means for non-rotatably connecting the other end of the at least one leaf spring to the switch-driving element, at least one of said connections permitting relative longitudinal movement between the at least one leaf spring and the respective element to which it is connected.

4. A manual operator as defined in claim 1 including a hollow rigid tube extending between the switch-driving element and the handle element, the resilient means being within the tube.

5. A manual operator as defined in claim 4 including an electrical insulator for interconnecting the handle element with the tube.

6. A manual operator as defined in claim 4 wherein the resilient means comprises at least one leaf spring extending longitudinally within the tube.

7. A manual operator as defined in claim 6 including a hub fixed to one end of the tube, the handle element including a bar fixed to and extending crosswise of the hub, and one end of the at least one leaf spring being fixed to the hub.

8. A manual operator as defined in claim 7 wherein the switch-driving element is rotatably carried by the end of the tube opposite the end to which the hub is fixed.

9. A manual operator as defined in claim 1 including a latch for optionally rigidly interconnecting the handle element to the switch-driving element, so that any rotation of the handle element is transmitted directly to the driving element, bypassing the resilient means.

10. A manual operator as defined in claim 9 including a rigid tube, one of the handle and switch-driving elements being fixed to the tube, the other of the elements being carried by and rotatable with respect to the tube, and the latch including a member for temporarily preventing relative rotation between said other of the elements and the tube.

11. A manual operator as defined in claim 10 wherein the latch includes a hole in the tube and a socket in said other element, the hole and socket being aligned when the resilient means is untensioned, and a rigid pin removably insertable into both the hole and socket simultaneously to lock the tube and said other element against relative rotation.

12. A manual operator as defined in claim 11 including a sleeve surrounding and slidable longitudinally along the tube, the pin being carried by the sleeve.

13. A manual operator as defined in claim 1 including a tube extending between the switch-driving and handle elements, one of the elements being fixed with respect to the tube and the other of the elements being rotatable with respect to the tube, the abutment being fixed to the tube, and the follower being carried by said other of the elements.

14. A manual operator as defined in claim 13 wherein the abutment is a semicylindrical collar, and the follower is a pin projecting from said other of the elements into the space between the longitudinal edges of the collar.

* * * * *